United States Patent [19]

Jones

[11] Patent Number: 4,787,449

[45] Date of Patent: Nov. 29, 1988

[54] OIL RECOVERY PROCESS IN SUBTERRANEAN FORMATIONS

[75] Inventor: Lloyd G. Jones, Dallas, Tex.

[73] Assignee: Mobil Oil Corporation, New York, N.Y.

[21] Appl. No.: 157,677

[22] Filed: Feb. 19, 1988

Related U.S. Application Data

[63] Continuation-in-part of Ser. No. 44,166, Apr. 30, 1987.

[51] Int. Cl.[4] ..... E21B 43/20; E21B 43/247

[52] U.S. Cl. ..... 166/259; 166/271; 166/274; 166/283

[58] Field of Search ..... 166/271, 274, 281, 283, 166/308, 292, 272, 259

[56] References Cited

U.S. PATENT DOCUMENTS

| | | | |
|---|---|---|---|
| 2,664,954 | 1/1954 | Johnson | 166/283 |
| 2,734,861 | 2/1956 | Scott, Jr. et al. | 166/283 X |
| 2,787,325 | 4/1957 | Holbrook | 166/281 |
| 2,805,721 | 9/1957 | Maly | 166/281 |
| 3,179,173 | 4/1965 | Jones, Jr. et al. | 166/283 |
| 3,303,882 | 2/1967 | Browning et al. | 166/292 |
| 3,537,529 | 11/1970 | Timmerman | 166/281 X |
| 3,682,245 | 8/1972 | Argabright et al. | 166/271 X |
| 3,845,822 | 11/1974 | Clampitt et al. | 166/283 X |
| 3,990,514 | 11/1976 | Kreinin et al. | 166/259 |

OTHER PUBLICATIONS

Rogers, Walter F., "Composition and Properties of Oil Well Drilling Fluids", 3rd Ed., Gulf Publishing Co., Houston, Tex., 1963, pp. 404, 405.

*Primary Examiner*—Stephen J. Novosad
*Attorney, Agent, or Firm*—Alexander J. McKillop; Michael G. Gilman; Lawrence O. Miller

[57] ABSTRACT

Oil recovery from a subterranean, oil-containing formation having relatively highly permeable and/or fractured zones and relatively low permeability zones is improved by first injecting a predetermined amount of a plugging agent into the formation, preferably inorganic, non-polymeric solids suspended in a fluid such as drilling muds or bentonite or clay suspensions, that plugs the face of the highly permeable and/or fractured zones of the formation. Thereafter, injection of the plugging agent is continued or in the alternative a displacing fluid at a flow rate and pressure sufficient to initiate and propagate new fractures and/or extensions of existing fractures in the formation. Thereafter, a displacing fluid is injected into the formation at a pressure sufficient to maintain the new fractures and/or extensions of existing fractures open and displace oil from zones communicating with the new fractures and/or extensions of existing fractures toward a production well where it is recovered. Formation of the new fracture and/or extensions of existing fractures enables additional oil-containing zones in the formation to be swept by the displacing fluid thereby improving oil recovery.

12 Claims, No Drawings

OIL RECOVERY PROCESS IN SUBTERRANEAN FORMATIONS

CROSS-REFERENCE TO RELATED APPLICATION

This application is a continuation-in-part of my copending application Ser. No. 044,166, filed Apr. 30, 1987, the entire contents of which is incorporated herein by reference.

FIELD OF INVENTION

This invention relates to a process for improving oil recovery from a subterranean, oil-containing formation by initially selectively plugging the face of permeable and/or fractured zones in the formation with a plugging agent, continuing to inject the plugging agent or in the alternative a displacing fluid to initiate and propagate new fractures and/or extensions of existing fractures in the formation and thereafter injecting a displacing fluid at a pressure sufficient to maintain the new fractures and/or extensions of existing fractures open and recover oil from zones in communication with the new fractures and/or extensions of existing fractures.

BACKGROUND OF THE INVENTION

A variety of supplemental recovery techniques have been employed in order to increase the recovery of viscous oil from subterranean viscous oil-containing formations. These techniques include thermal recovery methods, waterflooding and miscible flooding.

Heterogeneous hydrocarbon containing subterranean formations, i.e., formations having relatively high permeability zones and relatively lesser permeability zones, are difficult to efficiently flood by secondary and/or tertiary oil recovery processes because fluids preferentially migrate into the highly permeable zones in the subterranean formations. This process is aggravated by natural or accidental fracturing of the formation adjacent the injection well since such fractures commonly occur only in one or a few of the layers in layered formations. The migration described above is undesirable when injecting treatment fluids into oil-containing formations for the recovery of oil since the treatment fluids channel through the highly permeable and/or fractured zones bypassing the less permeable zones. The result is poor conformance and flow profiles of the treatment fluid in the formation. The hydrocarbons residing in the less permeable zones are not produced and the overall yield of hydrocarbons from the formation is reduced.

To increase the efficiency of formation flooding processes, the highly permeable and/or fractured zones in subterranean formations are plugged or partially plugged to prevent or educe migration of treatment fluids into them and to divert treatment fluids into adjacent, less permeable zones. In injection profile control projects, polymeric materials have been used in liquid slurries or suspensions to effectively enter and plug or partially plug the highly permeable and/or fractured zones of the formation. Fluids injected after such a treatment therefore move into unswept areas or zones of the reservoir which results in increased oil recovery.

Accordingly, it is a primary object of this invention to provide a process for improving oil recovery from a subterranean, oil-containing formation comprising first injecting a plugging agent that is stable at very high temperatures and which is very cheap in comparison to polymers into the formation that preferentially enters the highly permeable and/or fractured zones of the formation and plugs the face of said zones, continuing injection of the plugging agent or in the alternative a displacing fluid to form new fractures and/or extensions of existing fractures in the formation and injecting a displacing fluid into the formation at a pressure sufficient to maintain the new fractures and/or extensions of existing fractures open and displace oil from zones communicating with the new fractures and/or extensions of existing fractures toward a production well where it is recovered. Formation of the new fractures and/or extensions of existing fractures enables additional oil-containing zones in the formation to be penetrated by the displacing fluid for the recovery of oil thereby improving oil recovery from the formation.

SUMMARY OF THE INVENTION

The present invention provides a process for improving oil recovery from a subterranean, oil-containing formation having relatively highly permeable and/or fractured zones and relatively low permeability zones and penetrated by at least one injection well and a spaced-apart production well in substantial fluid communication with the formation. Initially, a predetermined amount of a plugging agent, preferably inorganic, non-polymeric solids suspended in a fluid such as drilling muds and bentonite or clay suspensions, is injected into the formation via the injection well which preferentially enters the highly permeable and/or fractured zones and plugs the face of these zones. Thereafter, injection of the plugging agent is continued or in the alternative a displacing fluid to initiate and propagate new fractures and/or extensions of existing fractions in the formation thereby creating additional locations in the formation for the recovery of oil. Thereafter, a displacing fluid in injected into the formation at a pressure sufficient to maintain the new fractures and/or extensions of existing fractures open and displace oil from zones communicating with said new fractures and/or extensions of existing fractures toward the production well where it is recovered.

DESCRIPTION OF THE PREFERRED EMBODIMENTS

The present invention provides a process for improving oil recovery from a subterranean, oil-containing formation having relatively highly permeable and/or fractured zones and relatively low permeability zones. The formation is penetrated by at least one injection well and a spaced-apart production well in substantial fluid communication with the formation. Initially, a predetermined amount of a plugging agent is injected into the formation via the injection well, preferably inorganic, non-polymeric solids suspended in a fluid such as drilling muds and bentonite or clay suspensions. The injected plugging agent preferentially enters the highly permeable and/or fractured zones and plugs the face of the highly permeable and/or fractured zones. The amount of plugging agent injected into the formation will vary depending upon formation characteristics and the degree of plugging desired. Thereafter, injection of the plugging agent is continued or in the alternative a displacing fluid until the injection pressure exceeds the desired fracture extension or fracture initiation pressure in an alternate layer of the formation to initiate and propagate new fractures in the formation and extend many or all of the previously plugged or partially plugged fractures. Injection of the plugging agent or displacing fluid at the higher injection pressure and sufficient flow rate is continued until the desired fracture pattern is obtained depending upon the characteristics of the formation. Thereafter, a displacing fluid is injected into the formation via the injection well at a pressure sufficient to maintain the new fracture and/or extensions of existing fractures open and displace oil from zones communicating with the new fractures and/or extensions of existing fractures toward the production well where it is recovered. The injection pressure of the displacing fluid must be sufficiently above the vertical fracture gradient so as to maintain the new fractures and/or extensions of existing fractures open and thus facilitate recovery of oil from these zones. Displacing fluids can be any fluid which effectively displaces crude oil from the formation, e.g., it can be an immiscible, miscible, or miscible-like displacing fluid. Suitable displacing fluids include steam, water, carbon dioxide or a combustion front. Forming new fractures and/or extensions of existing fractures in the formation enables additional oil-containing zones in the formation to be penetrated by the displacing fluid for the recovery of oil thereby improving oil recovery.

In another embodiment of my invention, a displacing fluid is injected into the formation that preferentially enters the high permeability zones and oil is recovered until the high permeability zones have been depleted. Thereafter, the present process of plugging the face of the high permeability zones and thereafter forming new fractures in other zones and/or extensions of existing fractures in the formation in communication with oil-containing zones from which oil is recovered.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

I claim:

1. A process for recovering oil from a subterranean, oil-containing formation having at least one injection well and a spaced-apart production well in substantial fluid communication with said formation and further having relatively high permeability and/or fractured zones and relatively lower permeability zones, comprising:

(a) injecting a predetermined amount of a plugging agent into the formation via the injection well which preferentially enters the highly permeable and/or fractional zones and plugs the face of said zones;

(b) continuing to inject said plugging agent into the formation at a flow rate and pressure sufficient to initiate and propagate new fractures and/or extensions of existing fractures in the formation; and (c) thereafter injecting a displacing fluid into the formation at a pressure sufficient to maintain the new fractures and/or extensions of existing fractures open and displace oil from zones communicating with said new fractures and/or extensions of existing fractures toward the production well where it is recovered.

2. The process of claim 1 wherein the plugging agent is inorganic, non-polymeric solids suspended in a fluid.

3. The process of claim 1 wherein the plugging agent comprises a drilling mud.

4. The process of claim 1 wherein the plugging agent comprises a clay suspension.

5. The process of claim 1 wherein the plugging agent comprises a bentonite suspension.

6. The process of claim 1 wherein the displacing fluid comprises water, carbon dioxide, steam or a combustion front.

7. A process for recovering oil from a subterranean, oil-containing formation having at least one injection well and a spaced-apart production well in substantial fluid communication with said formation and further having relatively high permeability and/or fractured zones and relatively lower permeability zones, comprising:

(a) injecting a predetermined amount of a plugging agent into the formation via the injection well which preferentially enters the highly permeable and/or fractional zones and plugs the face of said zones;

(b) injecting a displacing fluid into the formation at a flow rate and pressure sufficient to initiate and propagate new fractures and/or extensions of existing fractures in the formation; and (c) thereafter continuing to inject said displacing fluid into the formation at a pressure sufficient to maintain the new fractures and/or extensions of existing fractures open and displace oil from zones communicating with said new fractures and/or extensions of existing fractures toward the production well where it is recovered.

8. The process of claim 7 wherein the plugging agent is inorganic, non-polymeric solids suspended in a fluid.

9. The process of claim 7 wherein the plugging agent comprises a drilling mud.

10. The process of claim 7 wherein the plugging agent comprises a clay suspension.

11. The process of claim 7 wherein the plugging agent comprises a bentonite suspension.

12. The process of claim 7 wherein the displacing fluid comprises water, carbon dioxide, steam or a combustion front.

* * * * *